US006430886B1

(12) United States Patent
Schmitz

(10) Patent No.: US 6,430,886 B1
(45) Date of Patent: Aug. 13, 2002

(54) BUILDING STONE AND MASONRY FORMED THEREFROM

(75) Inventor: Michael Schmitz, Rheinmünster (DE)

(73) Assignee: F. von Langsdorff Licensing Ltd., Inglewood (CA)

( * ) Notice: Subject to any disclaimer, the term of this patent is extended or adjusted under 35 U.S.C. 154(b) by 0 days.

(21) Appl. No.: 09/831,246

(22) PCT Filed: Nov. 9, 1999

(86) PCT No.: PCT/EP99/08585

§ 371 (c)(1),
(2), (4) Date: May 8, 2001

(87) PCT Pub. No.: WO00/28165

PCT Pub. Date: May 18, 2000

(30) Foreign Application Priority Data

Nov. 10, 1998 (DE) ..... 198 51 674

(51) Int. Cl.[7] ..... E04C 2/04

(52) U.S. Cl. ..... 52/608; 52/604; 52/612; 404/41; 404/42

(58) Field of Search ..... 52/608, 609, 611, 52/612, 604; 404/37–42

(56) References Cited

U.S. PATENT DOCUMENTS

| | | | | |
|---|---|---|---|---|
| 1,795,451 A | | 10/1931 | Sharpe | |
| 3,418,774 A | | 12/1968 | Kocher | |
| 3,996,715 A | * | 12/1976 | Dowse | 52/593 |
| 4,075,812 A | * | 2/1978 | Koyama et al. | 52/747 |
| 4,128,357 A | * | 12/1978 | Barth et al. | 404/41 |
| 4,633,639 A | * | 1/1987 | Deimen | 52/590 |
| 4,834,575 A | * | 5/1989 | Barth et al. | 404/39 |
| 5,173,003 A | * | 12/1992 | Hair | 404/41 |
| 5,244,303 A | * | 9/1993 | Hair | 404/41 |
| 5,360,285 A | * | 11/1994 | Barth et al. | 404/37 |
| 5,361,557 A | * | 11/1994 | Snyder et al. | 52/608 |

FOREIGN PATENT DOCUMENTS

| | | |
|---|---|---|
| DE | 888 001 | 8/1949 |
| EP | 0 130 889 | 9/1985 |

* cited by examiner

*Primary Examiner*—Carl D. Friedman
*Assistant Examiner*—Yvonne M. Horton
(74) *Attorney, Agent, or Firm*—Paul Vincent

(57) ABSTRACT

A building block for forming a masonry structure comprises at least two stone members disposed one above the other and connected firmly to each other, each of which having a wide section at one end and a narrow section at the opposite end. The sections map into each other via an intermediate section and the stone members are disposed relative to each other in such a manner that, in each case, the wide section of an upwardly disposed stone member seats on the narrow section of the respective stone member lying beneath same and the narrow section of an upwardly disposed stone member seats on the wide section of the stone member lying beneath same. A wall built up from a plurality of building blocks disposed next to and one above another is built in such a manner that a wide section of a stone member of a building block seats next to a narrow section of a stone member of a neighboring building block, wherein neighboring building blocks can be displaced in height with respect to each other by one stone member layer such that the upper stone member of a building block seats next to a lower stone member of a neighboring building block.

9 Claims, 2 Drawing Sheets

BUILDING STONE AND MASONRY FORMED THEREFROM

BACKGROUND OF THE INVENTION

The invention concerns a building block for construction of masonry as well as a masonry structure consisting essentially of a plurality of building blocks disposed next to and above and below each other.

Masonry walls have been made for some time from a plurality of normally cuboid shaped building blocks disposed in a plurality of layers one above the other and connected to each other via intermediate layers of hardened mortar or laid down dry. The stability of a wall made in this manner is determined to a great extent by the mortar layer, which forms the weakest link in the transfer of forces from building block to building block. With masonry of this kind which is laid down dry, the horizontal transfer of forces is highly limited by mechanical friction between the building blocks.

Toothed building blocks have been conventionally used in order to improve the force transfer between neighboring building blocks of a layer of stones. DE 92 06 838 U1 thereby proposes a building block configuration comprising two differently sized hexagonal stone components disposed one behind the other in a layer of stones, which are connected to each other by means of a brace. The opposing disposition of the stone members leads to the formation of undercuts by means of which a building block can engage the corresponding neighboring building block of a layer of stones. In this manner, forces acting at right angles to the surface of a wall built from such building blocks can be transferred to the respective neighboring building blocks to thereby improve force transfer. Although masonry or walls built from such building blocks can be more stable than walls made from conventional cuboid building blocks, this structure has the associated disadvantage that a horizontal force transfer can only be effected in one axis direction of the wall and only in one respective layer of stones.

SUMMARY OF THE INVENTION

It is thereby the underlying purpose of the invention to create a building block of the above mentioned kind which guarantees an improved force transfer to neighboring building blocks. In addition, a masonry structure made from such building blocks should be created having high stability which preferably has the appearance of a single layer masonry structure made from cuboid blocks.

This purpose is achieved with respect to the building block in that the building block comprises at least two stone members disposed one above the other and firmly connected to each other, each of which has one end having a wide section and an opposite end having a narrow section, wherein the sections map into each other via an intermediate section and wherein the stone members are disposed relative to each other in such a manner that, in each case, the wide section of an upwardly disposed stone member seats on the narrow section of the respective stone member lying beneath same and the narrow section of the upper stone member seats on the wide section of the stone member lying beneath same.

The narrow section of each stone member forms a inwardly displaced shoulder relative to the wide section of the respective stone member, which, when used in a wall, engages with corresponding surfaces of the wide section of the neighboring building block. However, the simple structure of such a shoulder allows transfer of forces acting perpendicularly to the surface of the wall in one direction only. This effect is compensated for in accordance with the invention in that the stone members lying one above the other are each disposed with opposite orientations so that each stone member has differing force transfer functions in dependence on whether or not the force being transferred is exercised on the front or rear surface of the wall.

Since the stone members, disposed one above the other and firmly connected to each other, are disposed in a wall in stone layers or in partial stone layers, lying one above the other, the firm connection between the stone members also allows for force transfer between stacked layers.

A particularly simple geometric configuration can be effected when stone members having identical shape are used so that they can be manufactured economically. The stone members can thereby either be manufactured separately and be subsequently joined together into the building block or, alternatively, the building block can be made as a monolithic, single piece body.

The two stone components are preferentially rotated relative to each other through 180° about a vertical middle axis.

In a prereferred embodiment, the stone members have a substantially constant height i.e. have a smooth upper and lower side. This is particularly advantageous from a manufacturing point of view when the stone members are molded from concrete.

A particularly simple geometric form is effected when the wide and/or narrow section of the stone member is cuboid in shape and when the intermediate section has the shape of a truncated pyramid, wherein the base surface of the truncated pyramid corresponds to the cross sectional surface of the wider section and the surface area of the truncated side of the pyramid corresponds to the cross sectional surface of the narrower section.

Good force transfer to the stone members of neighboring building blocks can be effected when the slanting side surfaces of the intermediate section forming the transitional region between the side surfaces of the wide and the narrow sections are angled in a range between 30° to 60° and preferably by about 45°, relative to the adjacent side surfaces of the wide and narrow sections.

The building block in accordance with the invention can be worked in a simple manner when end surfaces of the stone members lying one above the other and forming a portion of the wall surface substantially lie in a vertical plane and preferably, in addition, when the side surfaces of the wide sections of the stone members extending substantially perpendicularly with respect to the surface of the wall substantially lie in a vertical plane.

For reasons of appearance, it is preferred when a feigned joint is formed between stone members disposes one above the other in the region of the visible surface.

The subsequent description is based on a building block having two stone members stacked one above the other. The advantages in accordance with the invention are however also effected using building blocks having three or more stacked stone members.

With respect to the masonry structure or the wall, the above mentioned purpose is achieved in that a plurality of building blocks in accordance with the invention are disposed next to and above and below each other, wherein neighboring building blocks are disposed relative to each other in such a manner that a wide section of a stone member of a building block lies next to a narrow section of a stone member of a neighboring building block. In this manner, very good force transfer is effected for forces exercised at right angles to the surface of the wall. Force transfer between neighboring building blocks is preferably achieved when adjacent stone members of neighboring building blocks seat on each other via their mutually facing side surfaces and via the intermediately disposed slanting surfaces of the intermediate member.

BRIEF DESCRIPTION OF THE DRAWINGS

The building blocks in accordance with the invention can be disposed in such a manner that they are rotated through 1800 about a vertical axis, in particular about the vertical middle axis. The building blocks seating next to each other thereby simultaneously form two layers of stone. However, in a preferred particularly advantageous embodiment of the invention, neighboring building blocks are vertically displaced with respect to each other by one partial stone layer such that the upper stone member of a building block lies next to a lower stone member of a neighboring building block. In this manner, a combed interconnection is also effected between stone layers disposed one above the other to thereby transfer external forces not only between sidewardly adjacent building blocks but also between building blocks lying above and below.

Further details and features of the invention can be extracted from the description of an embodiment with reference to the drawing.

DESCRIPTION OF THE PREFERRED EMBODIMENT

Figure 1:
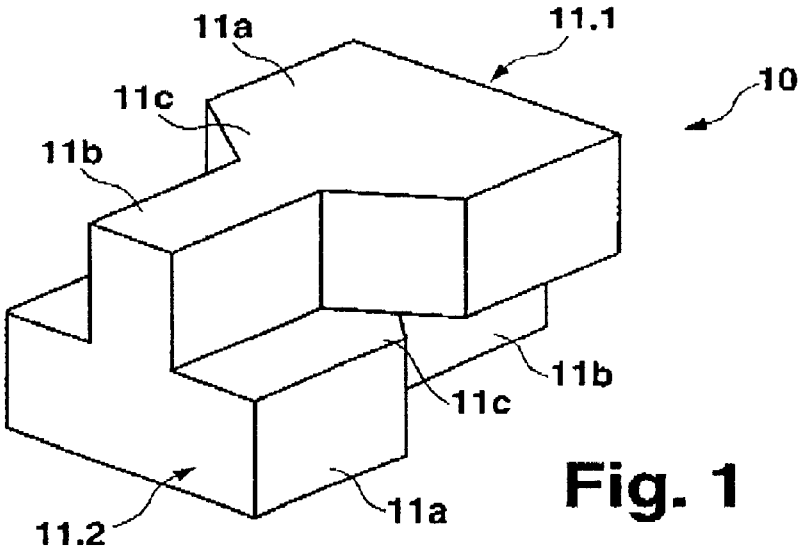
FIG. 1 shows a perspective view of a building block in accordance with the invention.
Figure 2:
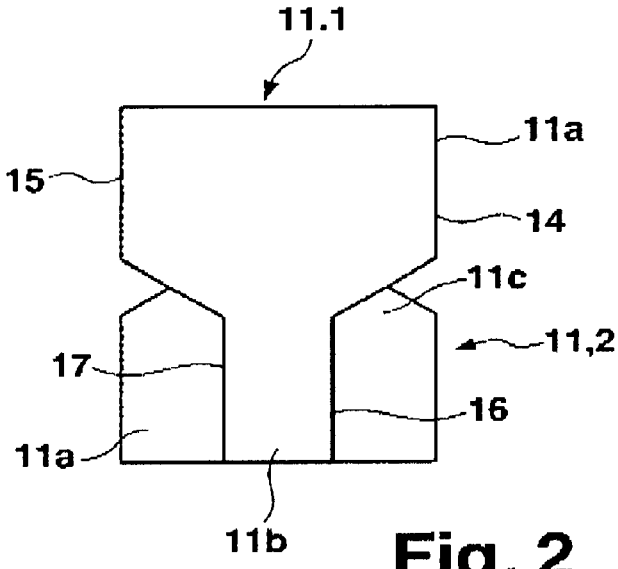
FIG. 2 shows a plan view of the building block in accordance with FIG. 1.
Figure 3:
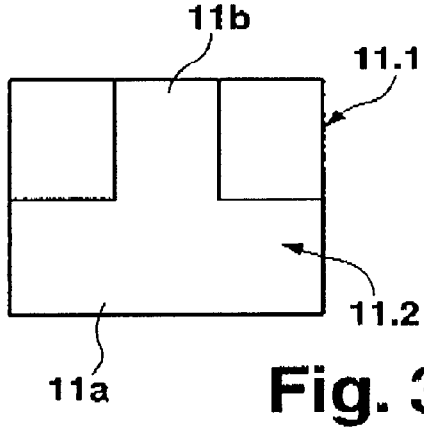
FIG. 3 shows a front view of the building block in accordance with FIG. 1.
Figure 4:
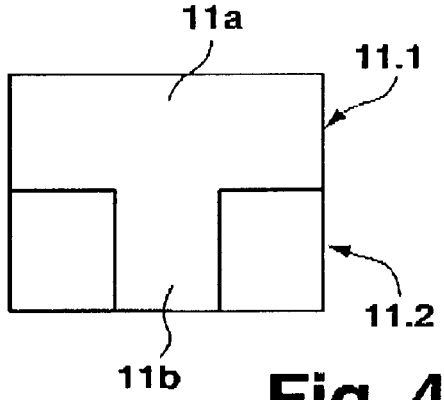
FIG. 4 shows a rear view of the building block in accordance with FIG. 1.
Figure 5:
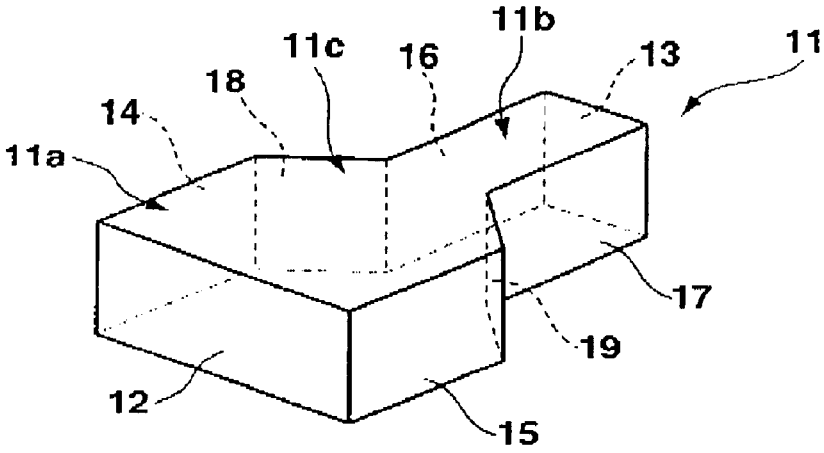
FIG. 5 shows a single stone member.

FIGS. 1 through 4 show a building block 10 for construction of a wall consisting essentially of two stone members 11.1 and 11.2 of identical shape disposed one above the other and firmly connected to each other. A single stone member 11 is shown in FIG. 5 and will be initially described. The stone member 11 consists essentially of a wide section 11*a* having a substantially cuboid shape, the wide end surface 12 of which is to comprise part of a wall surface of a wall constructed from the building blocks 10. A narrow section 11*b* is disposed at the opposite end of the stone member 11 and is likewise cuboid in shape, the end surface 13 of which opposite the end surface 12 of the wide section 11*a* likewise forming part of the surface of the wall. The narrow section 11*b* is centered relative to the wide sections 11*a* (also see FIG. 2) so that the side surfaces 16, 17 of the narrow section 11*b* extending at right angles with respect to the end surfaces 13 are displaced inwardly by equal amounts relative to the similar side surface 14, 15 of the wide section 11*a*. The side surfaces 14, 15 of the wide section 11*a* and the side surfaces 16, 17 of the narrow section respectively must not be parallel rather could be e.g. slightly tapered to facilitate curved travel.

A transitional or intermediate section 11*c* is disposed between the wide section 11*a* and the narrow section 11*b* and has the shape of a truncated pyramid whose base surface corresponds to the cross section of the wide section 11*1*, i.e. has the size of the end surface 12 thereof and is disposed adjacent thereto, and the top surface of which corresponds to the cross section of the narrow section 11*b*, i.e. corresponds to the size of its end surface 13 and is disposed adjacent thereto.

The stone member 11 has flat upper and lower surfaces to thereby have a substantially constant height so that the truncated pyramid shaped intermediate section 11*c* has slanted surfaces 18 and 19 at two sides only, which connect the side surfaces 14, 15 of the wide section 11*a* with the side surfaces 16, 17 of the narrow section 11*b*. The two slanted side surfaces 18, 19 of the intermediate section 11*c* are angled with respect to the adjacent side surfaces 14, 15, 16, 17 of the wide and narrow sections 11*a*, 11*b* by about 450.

The building block 10 shown in FIGS. 1 through 4 is made from two stone members 11.1 and 11.2 in accordance with FIG. 5. The two stone members 11.1 and 11.2 are disposed one above the other rotated through 180° about a vertical axis, preferably the vertical middle axis, so that the wide section 11*a* of the upper stone member 11.1 is disposed above the narrow section 11*b* of the lower stone member 11.2 and the narrow section of the upper stone member 11.1 is disposed above the wide section 11*a* of the lower stone member 11.2. The two stone members 11.1 and 11.2 are thereby stacked in such a manner that the end surfaces 12, 13 of the upper stone member 11.1 maps smoothly into the corresponding end surfaces of the stone member 11.2 lying beneath it, i.e. they substantially lie in a vertical plane. The side surfaces 14, of the wide section 11*a* of both stone members also substantially lie in a vertical plane.

The building block 10 can be retroactively built from prefabricated individual stone members 11 or can be manufactured as a monolithic body, preferably from concrete.

Figure 6:
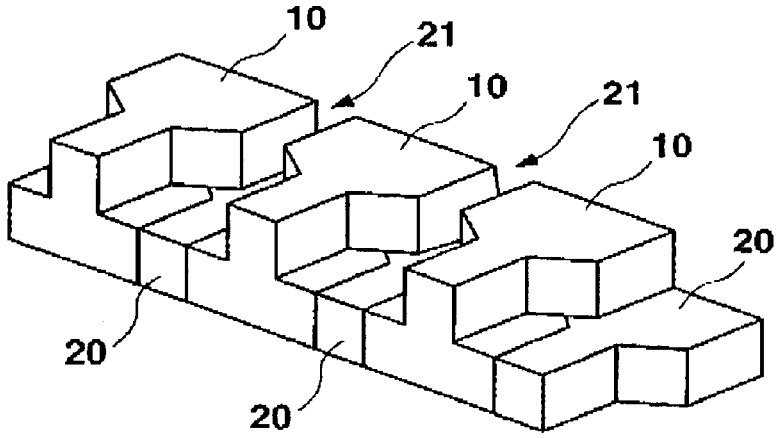
FIG. 6 shows a first phase of erection of a wall using the building blocks in accordance with the invention.

The building of a wall using the building blocks 10 is described with reference to FIGS. 6 and 7. In order to form a base layer, a plurality of building blocks 10 are disposed in the same orientation at separations with respect to each other, wherein the intermediate spaces between the building blocks 10 are filled up by intermediate pieces 20 having the shape of the stone member 11 shown in FIG. 5 and can therefore be designated as building block halves. The building blocks 10 and the intermediate pieces 20 are rotated through 180° about a vertical axis so that neighboring building blocks are disposed relative to each other in such a manner that a wide section of a stone member lies next to a narrow section of a neighboring stone member. Mutually adjacent stone members of neighboring building blocks seat on each other via their mutually facing side surfaces and the intermediate slanted surfaces of the intermediate section to effect mutual engagement of the building blocks. This situation is shown in FIG. 6.

As described below, the wall is built up through placement of building blocks 10 comprising two stone members 11.1 and 11.2, wherein the orientation of the building blocks is determined by the intermediate spaces 21 formed between the upwardly protruding stone members. The displacement between the wide section and the narrow section of a stone member formed via the intermediate section 11*c* facilitates engagement and therefore force transfer perpendicular to the surface of the wall. Since each building block consists essentially of a plurality of stone members firmly connected to each other, force transfer between layers of stone members stacked one above the other is also possible so that a generally highly stable, strong wall structure is effected. Pressure from earth e.g. at the rear side is thereby transferred not only to horizontally but also to vertically adjacent building blocks.

when the wall is built up to the desired height with the assistance of the building blocks 10, the intermediate spaces 22 remaining between the upwardly protruding stone members are filled up by additional intermediate members 20 to effect a closed upper side of the wall.

Figure 7:
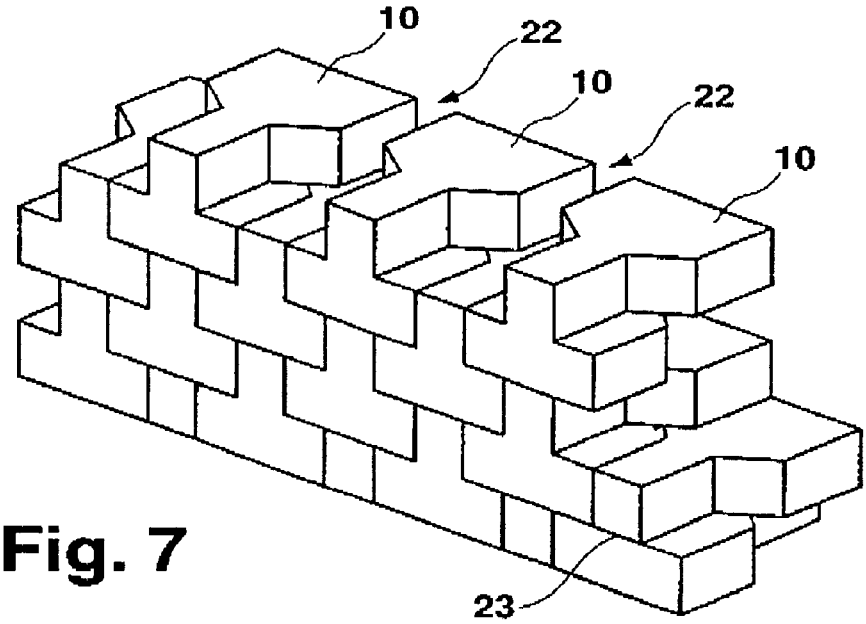
FIG. 7 shows the wall in accordance with FIG. 6 in a later construction phase.

For reasons of appearance, a feigned joint can be fashioned in the transitional region between the end surfaces of the upper stone member 11.1 and the respective end surface lying beneath same of the lower stone member 11.2 as shown by way of example in FIG. 7 on one building block in order to give the wall an appearance of a conventional masonry wall having individual layers.

I claim:

1. A building block for construction of a masonry structure, comprising:

a first stone member having a first shape, said first stone member having a first wide cuboid section, said first wide cuboid section having a first side surface extending substantially perpendicular to a surface of the masonry structure and lying in a substantially vertical first plane, said first wide section having a first opposite side surface extending substantially perpendicular to a surface of the masonry structure and lying in a substantially vertical second plane, said first stone member having a first narrow cuboid section, said first stone member having a first intermediate section disposed between and integral with said first wide cuboid section and said first narrow cuboid section, said first intermediate section having a first trapezoidal cross section with slanting opposite side surfaces, said first stone member having a first height; and a second stone member firmly connected to said first stone member, said second stone member having a second shape which is substantially identical to said first shape of said first stone member, said second stone member having a second narrow cuboid section which seats on said first wide cuboid section of said first stone member, said second stone member having a second wide cuboid section which seats on said first narrow cuboid section of said first stone member, said second stone member having a second height substantially equal to said first height.

2. The building block of claim 1, wherein said second side surface and said second opposite side surface extend substantially perpendicular to the surface of the masonry structure.

3. The building block of claim 2, wherein said second stone member is rotated, relative to said first stone member, through 180° about a vertical axis.

4. The building block of claim 3, wherein said vertical axis is a vertical middle axis.

5. The building block of claim 4, wherein said second wide cuboid section has a second side surface substantially lying in said first plane, said second wide cuboid section also having a second opposite side surface substantially lying in said second plane.

6. The building block of claim 1, wherein said slanting opposite side surfaces of said first intermediate section are angled relative to adjacent side surfaces of said first wide cuboid section and said first narrow cuboid section by one of between 30° to 60° and about 45°.

7. The building block of claim 1, wherein end surfaces of said first and second stone members lying one above the other and forming a portion of the masonry structure surface, substantially lie in a third vertical plane.

8. The building block of claim 1, wherein a feigned joint is formed on an end surface adjacent to said first and said second stone members.

9. The building block of claim 1, wherein the building block consists essentially of two stone members.

* * * * *